US005680895A

United States Patent [19]

Frasier

[11] Patent Number: 5,680,895

[45] Date of Patent: Oct. 28, 1997

[54] APPARATUS FOR DIRECTIONAL SOLIDIFICATION OF INTEGRAL COMPONENT CASTING

[75] Inventor: Donald J. Frasier, Greenwood, Ind.

[73] Assignee: Allison Engine Company, Indianapolis, Ind.

[21] Appl. No.: 660,062

[22] Filed: Jun. 3, 1996

Related U.S. Application Data

[62] Division of Ser. No. 478,459, Jun. 7, 1995, Pat. No. 5,568,833.

[51] Int. Cl.[6] ..... B22D 27/04; B22D 15/00

[52] U.S. Cl. ..... 164/348; 164/353; 164/361

[58] Field of Search ..... 164/348, 125, 164/126, 127, 128, 122.1, 122.2, 352, 353, 361

[56] References Cited

U.S. PATENT DOCUMENTS

| | | | |
|---|---|---|---|
| 3,417,809 | 12/1968 | Sink . | |
| 3,692,892 | 9/1972 | Lemelson . | |
| 3,700,023 | 10/1972 | Giamei et al. . | |
| 3,931,847 | 1/1976 | Terkelsen . | |
| 3,942,581 | 3/1976 | Sawyer . | |
| 3,957,105 | 5/1976 | Foye . | |
| 4,062,399 | 12/1977 | Lirones . | |
| 4,221,748 | 9/1980 | Pasco et al. . | |
| 4,240,495 | 12/1980 | Vonnegut . | |
| 4,436,385 | 3/1984 | Vonnegut . | |
| 4,520,858 | 6/1985 | Ryntz, Jr. et al. . | |
| 4,585,047 | 4/1986 | Kawai et al. . | |
| 4,706,732 | 11/1987 | Ruhlandt et al. . | |
| 4,813,370 | 3/1989 | Chiang . | |
| 5,072,771 | 12/1991 | Prasad | 164/352 |
| 5,259,441 | 11/1993 | Staub | 164/122.1 |
| 5,568,833 | 10/1996 | Frasier | 164/128 |

FOREIGN PATENT DOCUMENTS

| | | | |
|---|---|---|---|
| 1-113164 | 5/1989 | Japan | 164/122.1 |
| 5-220567 | 8/1993 | Japan | 164/122.1 |
| 1766596 A/1 | 10/1992 | U.S.S.R. . | |

OTHER PUBLICATIONS

English Abstract WPI/Derwent 93–319095.

*Primary Examiner*—Joseph J. Hail, III
*Assistant Examiner*—L.-H. Lin
*Attorney, Agent, or Firm*—Woodard, Emhardt, Naughton, Moriarty & McNett

[57] ABSTRACT

A apparatus casting a turbine wheel of a metal alloy, wherein there is generated a columnar grain structure parallel to the leading and trailing edges of the vanes, by directional solidification of the metal from the central aperture in the wheel outward to the vane tips. A form with cavity to receive therein the molten metal has a thin walled core in the center, with the core wall outer surface in place to provide one wall of the cavity. A heat transfer medium in fluid form is circulated through the core, thereby cooling the poured metal by heat transfer from the inner ends of the vanes outward to the tips.

23 Claims, 2 Drawing Sheets

APPARATUS FOR DIRECTIONAL SOLIDIFICATION OF INTEGRAL COMPONENT CASTING

This application is a division of application Ser. No. 08/478,459, filed Jan. 7, 1995 and now issued as U.S. Pat. No. 5,568,833.

BACKGROUND OF THE INVENTION

1. Field of the Invention

This invention relates generally to cast metal turbine wheels with integral airfoil blades, and more particularly to accommodation of contraction during solidification of the cast material.

2. Description of the Prior Art

Various methods have been devised for producing gas turbine wheels by casting metal. Some of these methods use a directional solidification approach for the blades in order to provide a columnar grain structure oriented generally radially with respect to the wheel axis and, accordingly, substantially parallel to the leading and trailing edges of each blade. Examples are shown and described in U.S. Pat. Nos. 4,240,495 issued Dec. 23, 1980, and U.S. Pat. No. 4,436,485 issued Mar. 13, 1984 to George L. Vonnegut. Both of these patents disclose chill material in the mold around the perimeter of the blade tip circle so that, as the cast material cools, the heat transfer is radially outward from the blade tip portions of the mold into the chill material. The result is establishment of the grains of the solidifying metal from the blade tips inwardly in a columnar fashion. In short, the blades are solidified unidirectionally from outside to inside by withdrawing heat through the chill material located immediately radially outboard of the blade tip portion of the mold cavity. Because of the arrangement of the mold, there is a relatively large mass of material in the disk forming portion of the mold cavity. Grain growth in the disk portion was isotropic, and equiaxed grains were formed in that portion of the wheel.

As is often true in metal casting, shrinkage during cooling can create some problems. At least one of those problems is development of high stresses and tears or cracks. Another is a tendency of the outer portion of the casting at the blade tips to move away from the chill material in the mold and thus detract from the heat transfer to the chill material. But efforts to incorporate a chill inboard of the blades in order to accomplish directional solidification outward from a central aperture usually have been frustrated prior to the present invention, because contraction onto a central chill has been even more conducive to high stresses and hot tears or cracks. Such stresses may also contribute to recrystallization upon subsequent high temperature heat treatment of the turbine wheel. The same effect may also occur as a result of high temperatures in actual use of the wheel in a gas turbine assembly.

SUMMARY OF THE INVENTION

Described briefly, according to a typical embodiment of the present invention, for use with a shell mold having a cavity therein to form a turbine wheel, a chill is provided in the form of a collapsible frustoconical pedestal whose outer surface forms a wall of the cavity near the center thereof. A temperature controlled fluid is provided in the chill to provide controlled heat transfer from the mold cavity through the chill toward the axis of the wheel. Consequently, the grain development is columnar from the inside of the wheel to the outside so that the columnar grain structure in each of the turbine blades is provided parallel to the leading and trailing edges of the blades. The chill is collapsible so that during contraction of the cast material as it solidifies, stresses are not developed between the casting and the chill but, at the same time, good heat transferring contact is maintained between the chill and the solidifying casting.

DESCRIPTION OF THE PREFERRED EMBODIMENT

Figure 1:
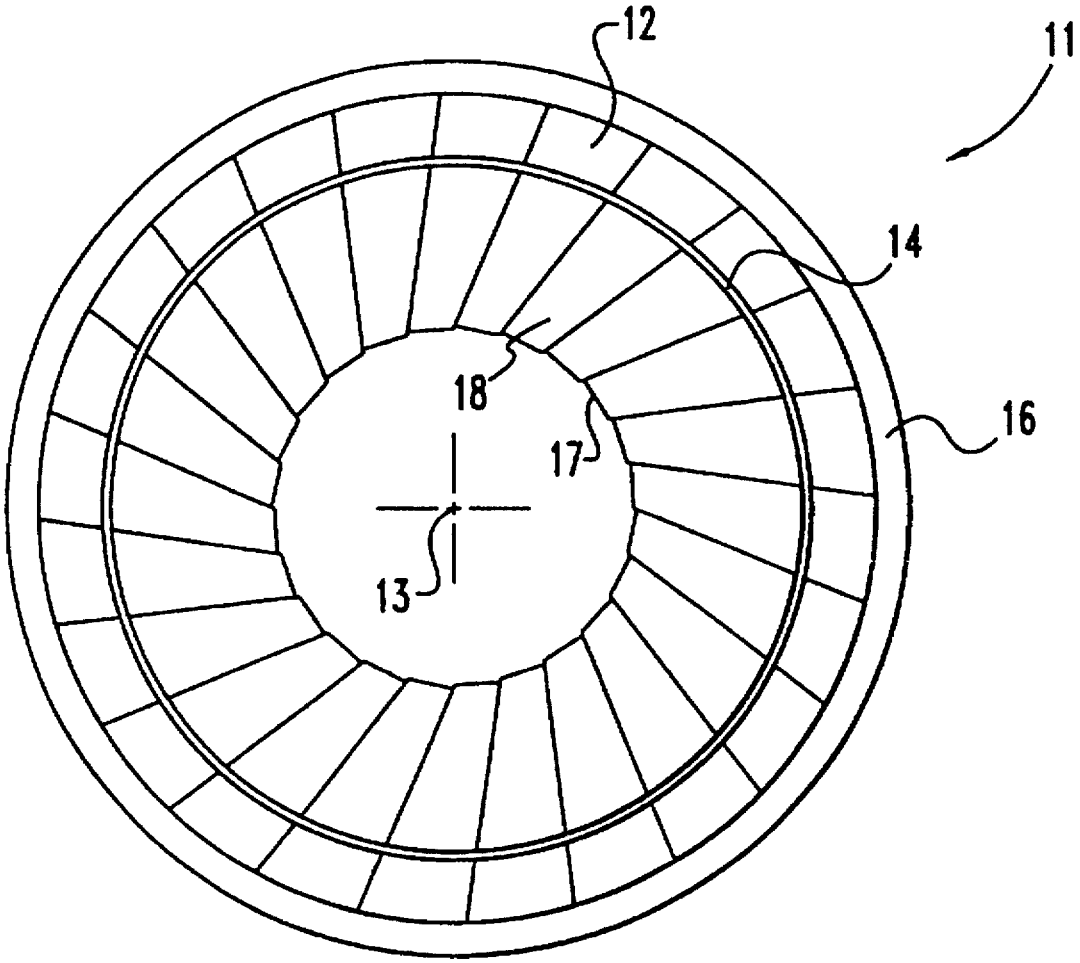
FIG. 1 is a view along the axis of a turbine wheel casting to be manufactured with the apparatus and according to the method of this invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, the gas turbine wheel 11 includes a plurality of blades 12 circularly spaced around the axis 13. Annular walls 14 and 16 concentric on axis 13 define the inner and outer boundaries of the airfoil vanes 12 in the turbine wheel but, in the raw casting, the vanes extend inward from wall 14 to the inner ends of the vanes which are disposed in a circle about the axis 13. The inner portions 18 of the cast vanes inboard from wall 14 are cut away and scrapped by machining subsequent to the casting, as are some of the other flanges, to make the finished part.

Figure 2:
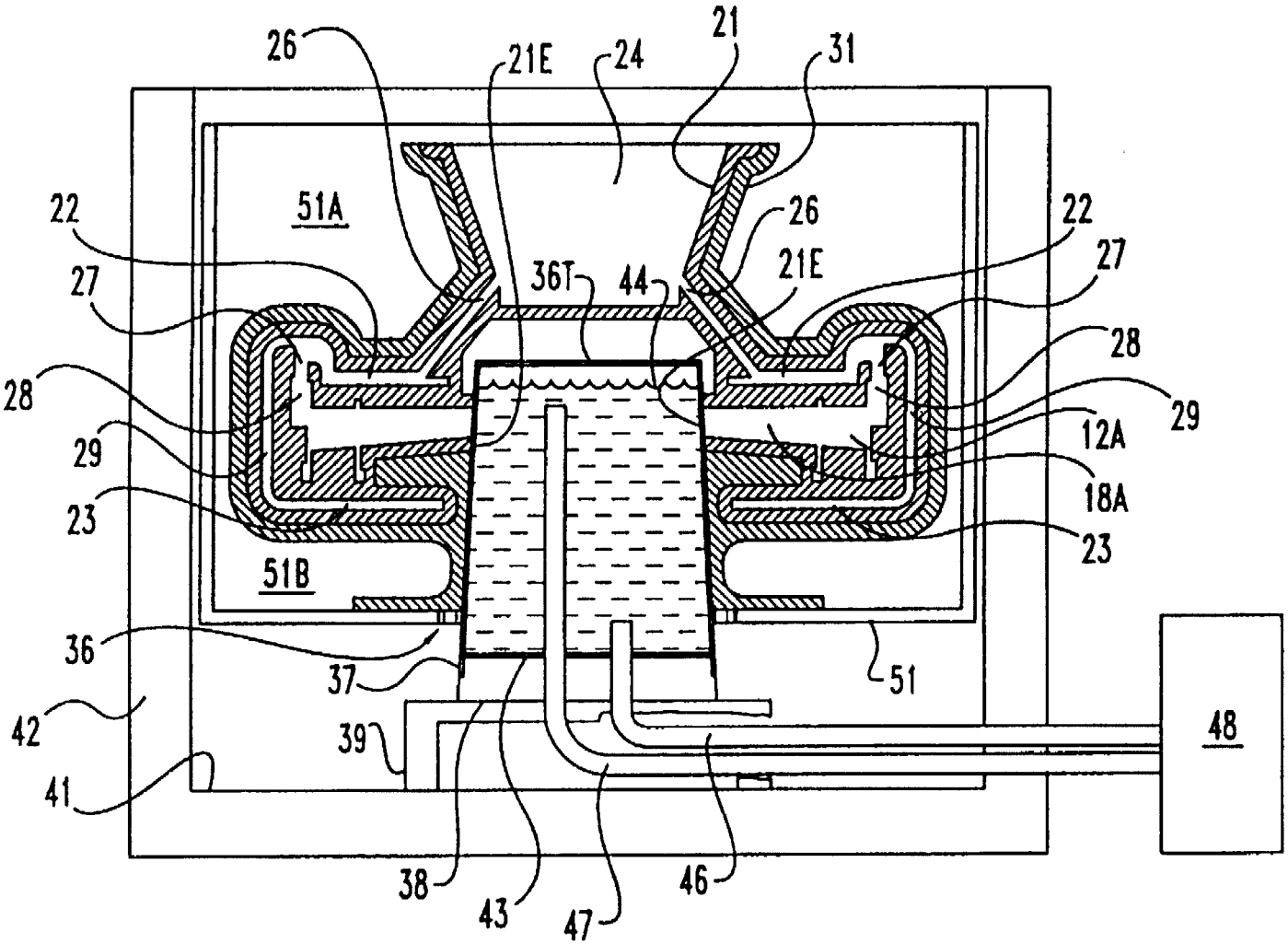
FIG. 2 is a vertical sectional view of casting apparatus incorporating and operating according to the method of my invention.

Now that the general configuration of the cast part has been described, the process for making it will be described. Referring now to FIG. 2, a refractory shell mold 21 is formed around a wax pattern shaped to define the cavity to form the cast part. That turbine wheel cavity includes the outer chambers 12A and inner chambers 18A which are contiguous with each other but the casting vane portion from mold chamber 12A will be eventually saved, whereas the casting vane portion from mold chamber portions 18A will be cut away as discussed above.

In addition to the turbine wheel cavity, there are upper and lower annular temperature maintenance cavities. The cavity 22 call be a continuous cavity with support posts circularly spaced around it, or a plurality of separate circularly spaced cavities can be used and fed as needed from the metal supply pot 24 through the sprues 26. Circularly spaced, round gates 27 at the outer ends of the cavities 22 feed into annular supply cavities 28 to feed into all of the turbine vane cavities around the entire circumference. Although only eight or ten of the gates 27 might be needed for the illustrated casting, the supply cavity 28 extends entirely around the circumference to provide ample material supply to fill the vane cavities. Additional gates 29 can be provided at spaced locations around the circumference of the wheel to provide either a continuous annular cavity 23 below the wheel cavity or a plurality of circularly spaced cavities there. The purpose of these upper and lower temperature maintenance cavities is essentially the same as that of the cavity portions 42 in the above-mentioned U.S. Pat. No. 4,436,485.

The materials of which the shell mold 21 is made, and the process of making the shell molds can be the same as that in the aforementioned patent. Insulation 31 can be applied to the outer surface of the shell mold. The mold making and insulation materials, and methods for applying these materials, can be the same as described in the aforementioned patents, the disclosure of those patents being incorporated herein in their entireties by reference. But in contrast to those patents, wherein the chills for the blades comprise steel shot situated outboard of the blade cavity, the chill according to the present invention includes a thin walled container 36 with a heat transfer fluid inside.

In the illustrated example, the container wall 37 has a 2.5° draft so it is frustoconical with an included cone angle of five degrees overall. The lower end 38 of container 36 may rest on a stand 39 resting on the bottom 41 of the furnace 42. The chill is closed at the top wall 36T and has an inner wall 43 spaced slightly above the stand 39.

in the illustrated example, this chill has a chill fluid in liquid form therein up to the level 44. A continuous change of the liquid to maintain a constant temperature therein that can be provided by supply pipe 46 near the bottom and return pipe 47 whose entrance is near the top, these pipes being connected to a temperature control system 48 outside the furnace and which can provide appropriate cooling through heat exchangers or the like for the chill liquid. It should be understood that a chill fluid such as a gas could also be used.

The shell mold can be placed down around the chill wall 37 so that the inner edge 21E of the mold and which is continuous and circular is snug on the slightly conical outer surface of the chill wall, thus providing a seal around the inner end of each of the turbine blade cavities. The top of the chill is low enough with respect to the bottom of the mold shell so that the mold shell can be lowered to the point where there is a full and complete perimetrical seal at 21E around the chill.

With the shell mold suitably in place and insulation placed around it both above and below in the chambers 51A and 51B of can 51, the furnace is either evacuated, or filled with inert gas and heated to a suitable temperature. Then the mold material is deposited in the cup 24 in conventional manner and descends through the sprues and gates and fills the turbine wheel cavity as well as the temperature maintenance cavities. The chill liquid is circulated through the chill and heat is transferred from the molten metal through the wall 37 of the chill into the chill liquid and removed through the piping 47. Accordingly, solidification of the blade metal in the cavity begins at the inside diameter thereof and progresses outward toward the blade tip and supply cavities 28. A columnar grain structure is thereby provided, achieving the desired directional solidification. The liquid in cavities 22 and 23 provides sufficient heat to prevent premature cooling of the blade leading and trailing edges which are near the top and bottom of the casting, so that columnar grain structure development is assured. When the casting has solidified, the mold with casting therein is removed from the furnace. The chill may remain in place for use with, the next mold to be poured.

On the other hand, if desired, the entire assembly of chill and mold can be bodily removed from the furnace. Of course, suitable connector fittings for the chill fluid circulation system would be necessary. In a still further embodiment, The chill itself could be provided with sufficient capacity that the solidification could be completed without additional cooling from the exterior.

As indicated above, the shell mold insulating material can be the same and applied in the same manner as described in the above-mentioned U.S. Pat. No. 4,436,485. Similarly, the furnace temperatures and the cast metal materials can be the same as described in that patent, as well as the casting temperature. Of course, the chill employed according to the present invention is different from the prior patent. An, example of a suitable material is copper with a wall thickness of 1.6 mm. As the material in the turbine wheel cavity contracts during solidification, the inner ends 17 of the vanes push inward on the wall surface 37 of the chill. Due to the relatively thin wall thickness, the chill will be deformed to the extent necessary to accommodate the contraction. Accordingly, no undue stress develops in the casting, thus avoiding the development of hot tears or cracks in the casting.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus for casting a molten material to form a product, the apparatus comprising:

a casting mold having an aperture formed therein, said mold having a cavity for receiving the molten material therein for later solidification in the cavity shape, said cavity having at least one opening connecting into said aperture; and a deformable fluid cooled container positioned within said aperture and having an outer surface positioned adjacent said at least one opening for blocking the escape of molten material from said cavity, said container for transferring heat from the molten material in said cavity so as to assist the molten material to change phase from liquid to solid in a direction which is outward from the outer surface of the container, wherein said container deforms so as to minimize stress as the molten material contracts during solidification.

2. The apparatus of claim 1, wherein said container having a top wall, a bottom wall and a circumferential sidewall, and wherein upon said container being deformed said bottom wall does not move relative to said mold.

3. The apparatus of claim 2, wherein said sidewall being thin.

4. The apparatus of claim 3, wherein said sidewall having a thickness of about 1.6 millimeters.

5. The apparatus of claim 4, wherein said container sidewall being formed of copper.

6. The apparatus of claim 5, wherein said container being formed of copper.

7. The apparatus of claim 6, which further comprises:

a furnace; and said apparatus being positioned within said furnace, and said furnace being in a state that is one of an evacuated volume and an inert gas filled volume.

8. The apparatus of claim 7, wherein the apparatus positioned on a platform, said platform positioned within said furnace.

9. The apparatus of claim 1, wherein said container is tapered.

10. The apparatus of claim 9, wherein said container having an included cone angle of about five degrees.

11. The apparatus of claim 1, wherein there is a perimetrial seal between the outer surface of said container and said mold.

12. The apparatus of claim 1, wherein said container having a fluid heat transfer medium therein for transferring heat from the outer surface of said container.

13. The apparatus of claim 12, which further comprises at least one heat transfer medium supply pipe connecting to said container.

14. The apparatus of claim 13, which further comprises a heat transfer medium return pipe connecting to said container.

15. The apparatus of claim 14, wherein said heat transfer medium supply pipe having one end positioned within said container for discharging heat transfer medium near the bottom of said container, and wherein said heat transfer medium return pipe having one end positioned within said container for receiving heat transfer medium near the top of said container.

16. The apparatus of claim 14, which further comprises a heat exchanger, said heat exchanger being in fluid communication with said heat transfer medium supply pipe and said heat transfer medium return pipe for removing energy from said heat transfer medium.

17. The apparatus of claim 1, which further comprises a first temperature maintenance cavity positioned along said cavity for preventing the premature cooling of at least a portion of the molten material within said cavity.

18. The apparatus of claim 17, wherein said first temperature maintenance cavity being positioned above said cavity, and wherein said first temperature maintenance cavity for receiving molten material therein.

19. The apparatus of claim 18, which further comprises a second temperature maintenance cavity positioned below and along said cavity for preventing the premature cooling of at least a portion of the molten metal within said cavity, and wherein said second temperature maintenance cavity for receiving molten material therein.

20. The apparatus of claim 1, wherein at least a portion of said outer surface of said container being in circumferential contact with said mold and said cavity.

21. The apparatus of claim 1, wherein said mold and said container are concentric about a central axis.

22. The apparatus of claim 1, wherein said container occupying substantially the entire cross sectional area of said aperture.

23. In combination:

a furnace;

an apparatus for casting a molten material to form a product, said apparatus being positioned within said furnace, said apparatus, comprising:

a casting mold having an aperture formed therein, said mold having a substantially annular molten material receiving cavity formed therein, said molten material receiving cavity for receiving molten material therein for later solidification in said cavity shape, said cavity having a plurality of evenly spaced openings connecting to said aperture;

a thin walled fluid cooled container positioned within said aperture, said container having a sidewall with an outer surface contacting said mold so as to form a perimetrial seal between said container and said mold for preventing the passage of molten material from said cavity into said aperture, said container having an interior volume isolated from said mold and substantially filled with a liquid heat transfer medium to transfer heat from the molten material within said cavity so as to assist the molten material in changing phase from a liquid to a solid in a direction which is outward from the surface of said container, said sidewall being deformable so as to minimize the internal stress as the molten material contracts during solidification;

a heat transfer medium supply passageway connecting to said container, said heat transfer medium supply passageway having one end positioned within said container near the bottom of said container for discharging heat transfer medium;

a heat transfer medium return passageway connecting to said container, said heat transfer medium return passageway having one end positioned within said container near the top of said container for receiving heat transfer medium;

a heat exchanger for removing energy from said heat transfer medium, said heat exchanger being in fluid communication with said heat transfer medium return passageway and said heat transfer medium supply passageway, whereby the heat transfer medium being circulated continuously between said heat exchanger and said container.

* * * * *

UNITED STATES PATENT AND TRADEMARK OFFICE
CERTIFICATE OF CORRECTION

PATENT NO : 5,680,895

DATED : October 28, 1997

INVENTOR : Donald J. Frasier

It is certified that error appears in the above-identified patent and that said Letters Patent are hereby corrected as shown below:

In Col. 1, line 6, replace "January 7, 1995." with -- June 7, 1995 --.

In Col. 3, line 19, replace "in" with -- In --.

Signed and Sealed this

First Day of May, 2001

*Attest:*

Nicholas P. Godici

NICHOLAS P. GODICI

*Attesting Officer*

*Acting Director of the United States Patent and Trademark Office*